US010339793B2

(12) United States Patent
Moffa

(10) Patent No.: US 10,339,793 B2
(45) Date of Patent: Jul. 2, 2019

(54) SYSTEM AND METHOD FOR SMOKE DETECTOR PERFORMANCE ANALYSIS

(71) Applicant: JOHNSON CONTROLS FIRE PROTECTION LP, Boca Raton, FL (US)

(72) Inventor: Anthony Philip Moffa, Northborough, MA (US)

(73) Assignee: JOHNSON CONTROLS FIRE PROTECTION LP, Boca Raton, FL (US)

( * ) Notice: Subject to any disclaimer, the term of this patent is extended or adjusted under 35 U.S.C. 154(b) by 0 days.

(21) Appl. No.: 14/814,805

(22) Filed: Jul. 31, 2015

(65) Prior Publication Data

US 2017/0032661 A1 Feb. 2, 2017

(51) Int. Cl.

*G08B 29/00* (2006.01)
*G08B 29/04* (2006.01)
*G08B 29/14* (2006.01)

(52) U.S. Cl.

CPC ..... *G08B 29/043* (2013.01); *G08B 29/145* (2013.01)

(58) Field of Classification Search

CPC ..... G08B 29/043; G08B 29/145
USPC ..... 340/506, 3.1, 533, 514, 630, 629, 511, 340/574, 540, 691.5; 709/203, 221, 224, 709/227; 700/28, 300
See application file for complete search history.

(56) References Cited

U.S. PATENT DOCUMENTS

2003/0090374 A1* 5/2003 Quigley ..... G08B 19/005 340/506
2004/0217857 A1* 11/2004 Lennartz ..... G08B 29/145 340/514
2006/0007010 A1* 1/2006 Mi ..... G08B 17/107 340/630
2006/0012472 A1* 1/2006 Eskildsen ..... G08B 29/22 340/511
2011/0215923 A1* 9/2011 Karim ..... G08B 25/006 340/540
2012/0050030 A1* 3/2012 Murphy ..... G08B 29/145 340/514
2014/0015668 A1* 1/2014 Hanses ..... G08B 17/107 340/514
2014/0136379 A1* 5/2014 Smith ..... G06Q 30/04 705/34
2015/0206423 A1* 7/2015 Warmack ..... G08B 17/10 340/514
2016/0035246 A1* 2/2016 Curtis ..... H04L 67/10 434/219
2016/0036944 A1* 2/2016 Kitchen ..... H04L 65/102 709/203

* cited by examiner

*Primary Examiner* — Dhaval V Patel
(74) *Attorney, Agent, or Firm* — Arent Fox LLP

(57) ABSTRACT

A system for facilitating smoke detector performance analysis including a server configured to receive operational data from an alarm panel and to perform analytics using the operational data, wherein the operational data is associated with at least one smoke detector that is operatively connected to the alarm panel.

22 Claims, 7 Drawing Sheets

Actions Ahead 600

Dirty Detectors List 610

| Channel 611 | Dev # 612 | Custom Label 613 | Average Value 614 |
|---|---|---|---|
| M5 | 6 | AUDITORIUM WING A102 4 | 120 |
| M1 | 50 | CORRIDOR 2 TECH B412 M1 | 115 |

Detectors Predicted to Become Dirty 620

| Channel 621 | Dev # 622 | Custom Label 623 | Almost Dirty 624 | Dirty 625 | Excessively Dirty 626 |
|---|---|---|---|---|---|
| M4 | 85 | AUDITORIUM WING CORRIDOR | 15-May-2018 | 8-Jun-2019 | 29-Nov-2022 |
| M4 | 51 | WING 4 TECH C104 M4 | 6-Jul-2020 | 19-Aug-2021 | 23-Jan-2023 |
| M3 | 73 | WING 5 BOILER RM | 11-Dec-2018 | 25-Sep-2019 | 27-Mar-2024 |
| M1 | 78 | 3RD FLOOR ART ROOM | 30-Jul-2017 | 11-Mar-2019 | 27-Sep-2022 |
| M3 | 82 | WING 3 CORR FACULTY DINING | 26-Dec-2019 | 7-Nov-2020 | 21-Mar-2026 |
| M1 | 20 | WING 5 VERANDA | 24-May-2018 | 1-Sep-2019 | 16-Feb-2021 |
| M2 | 80 | WING 7 VESTIBULE | 15-Oct-2019 | 9-Jun-2021 | 2-Oct-2023 |
| M3 | 52 | WING 2 CORRIDOR | 24-Oct-2019 | 9-Apr-2020 | 25-Jun-2022 |
| M2 | 17 | WING 3 STUDENT DINING | 10-Mar-2020 | 29-Nov-2022 | 14-Feb-2027 |
| M1 | 38 | WING 2 SHOP RM | 13-Aug-2020 | 2-Dec-2022 | 15-Jun-2027 |

Fig. 6

SYSTEM AND METHOD FOR SMOKE DETECTOR PERFORMANCE ANALYSIS

FIELD OF THE DISCLOSURE

The disclosure relates generally to fire safety systems, and more particularly to a system and method for facilitating convenient performance analysis of smoke detectors in fire safety systems.

BACKGROUND OF THE DISCLOSURE

Fire safety systems are a ubiquitous feature of modern building infrastructure and are critical for safeguarding the occupants of buildings and other protected areas against various hazardous conditions. Fire safety systems typically include a plurality of smoke detectors that are distributed throughout a building or area, each connected to one or more centralized alarm panels that are configured to activate notification devices (e.g., strobes, sirens, etc.) to warn occupants of the building or area if a hazardous condition is detected.

A conventional smoke detector includes a housing that defines a detection chamber that is partially open to a surrounding environment. The detection chamber may contain a light source and a photoelectric sensor that may be separated by a septum that prevents light emitted by the light source from traveling directly to the photoelectric sensor. However, if smoke from the surrounding environment enters the detection chamber, particulate in the smoke may provide a reflective medium by which light from the light source may be reflected to the photoelectric sensor. If the particulate in the detection chamber is sufficiently dense and reflects enough light to the photoelectric sensor, the output of the photoelectric sensor may exceed a predefined "alarm threshold" and may cause an associated alarm panel to initiate an alarm.

A shortcoming that is associated with conventional smoke detectors is that the components of such detectors can become dirty over time due to the buildup of dirt, dust, and other particulate which may adversely affect the operation of a smoke detector. For example, such "non-smoke" particulate may accumulate in the detection chamber of a smoke detector and may provide a reflective medium similar to smoke. This may cause a photoelectric sensor of a smoke detector to generate output indicative of an alarm condition (e.g., a fire) when no such condition exists. Additionally, even if the amount of non-smoke particulate that has accumulated in a smoke detector is not by itself sufficient to result in an alarm, a combination of the non-smoke particulate and an amount of "smoke," that would not by itself produce an alarm, may cause a photoelectric sensor to generate output above an associated alarm threshold. The non-smoke particulate may therefore reduce the operating range of a smoke detector by artificially pushing the sensor output nearer the alarm threshold. This may be of particular concern with regard to smoke detectors that are located in areas that are normally dirty with highly variable levels of airborne particulate (e.g., loading docks, boiler rooms, etc.).

In view of the foregoing, it is important to clean smoke detectors in a fire safety system periodically to ensure that the operating ranges of the smoke detectors are not significantly compromised by the accumulation of non-smoke particulate. However, the task of cleaning smoke detectors can be tedious and time consuming, especially in fire safety systems that include dozens, hundreds, or even thousands of smoke detectors. The sheer scope of the population of detectors to be cleaned combined with the relatively "unknown" dirty state can result in mismanaged cleaning activities. The burden of this task can be reduced by identifying which smoke detectors in a fire safety system are actually dirty and in need of cleaning and further, knowing how effective the cleaning process was. However, operational data that facilitates the identification of dirty smoke detectors is typically stored in the alarm panels of a fire safety system, which themselves are often numerous, widely distributed, and difficult to access.

In view of the forgoing, it would be advantageous to provide a system and a method for providing a convenient indication of which smoke detectors in a fire safety system are dirty and to what degree they are dirty. It would further be advantageous to provide such a system and method that can predict when the smoke detectors in a fire safety system will require cleaning. It would further be advantageous to provide such a system and method that can provide a convenient indication of the stability of the environment the smoke detector is installed in and, finally, how well the smoke detectors in a fire safety system have been cleaned.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a system for smoke detector performance analysis in accordance with the present disclosure may include a server configured to receive operational data from an alarm panel and to perform analytics using the operational data, wherein the operational data is associated with at least one smoke detector that is operatively connected to the alarm panel.

An exemplary embodiment of a method for smoke detector performance analysis in accordance with the present disclosure may include receiving, at a server, operational data from an alarm panel, the operational data being associated with a smoke detector connected to the alarm panel, and performing analytics using the operational data

BRIEF DESCRIPTION OF THE DRAWINGS

By way of example, a specific embodiment of the disclosed device will now be described, with reference to the accompanying drawings, in which:

FIG. 6 is a chart illustrating how data may be presented to an end user in accordance with the present disclosure;

DETAILED DESCRIPTION

Figure 1:
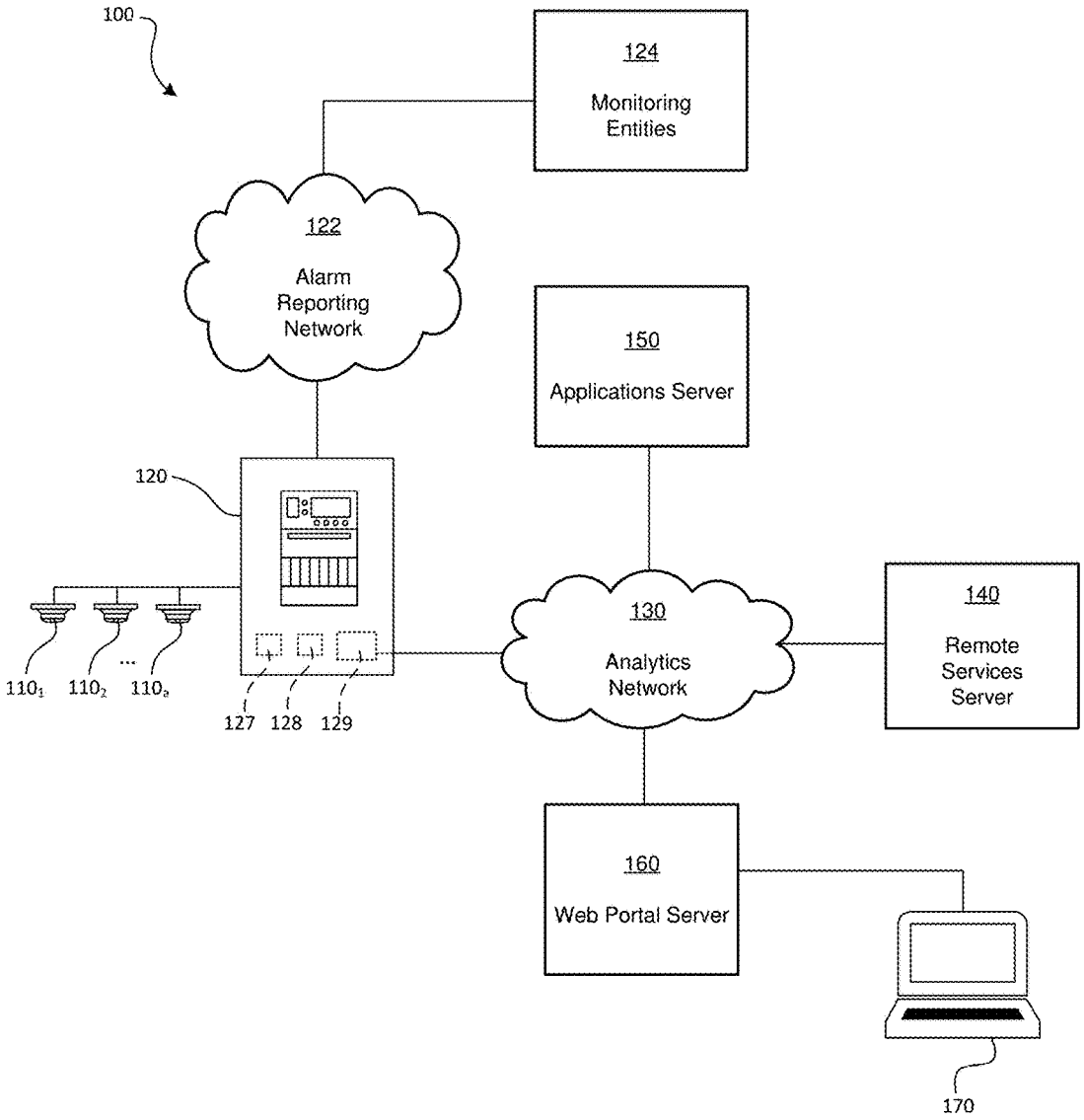
FIG. 1 is a schematic diagram illustrating an exemplary embodiment of a fire safety system for facilitating smoke detector performance analysis in accordance with the present disclosure.

A system and method in accordance with the present disclosure will now be described more fully hereinafter with reference to the accompanying drawings, in which preferred embodiments of the system and method are shown. The system and method, however, may be embodied in many different forms and should not be construed as being limited to the embodiments set forth herein. Rather, these embodiments are provided so that this disclosure will be thorough and complete, and will fully convey the scope of the system and method to those skilled in the art. In the drawings, like numbers refer to like elements throughout unless otherwise noted.

Referring to FIG. 1, an exemplary fire safety system 100 (hereinafter "the system 100") that is adapted to facilitate convenient performance analysis for smoke detectors in the system 100 is shown. The system 100 may include one or more smoke detectors $\mathbf{110}_1$-$\mathbf{110}_a$ (wherein "a" can be any positive integer) operatively coupled to a centralized alarm panel 120, for example. The smoke detectors $\mathbf{110}_1$-$\mathbf{110}_a$ may be located within a single site (e.g., a single monitored building or area) or scattered throughout different sites. While only one alarm panel 120 is shown for the purpose of illustration, it will be understood that the system 100 may include one or more additional alarm panels, each associated with a plurality of additional smoke detectors, without departing from the scope of the present disclosure.

Each of the smoke detectors $\mathbf{110}_1$-$\mathbf{110}_a$ may be adapted to measure a level of ambient smoke or other particulate in a surrounding environment and to generate a digital output value representing such level. The digital output value may be an 8 bit value ranging from 0 to 255, though it is contemplated that the output value may be expressed using a greater or fewer number of bits (e.g., 16 bits, 32 bits, etc.). A greater output value represents a greater amount of detected smoke or other particulate. The output value may be expressed in units of "counts" (e.g., 150 counts, 223 counts, etc.) as will be familiar to those of ordinary skill in the art. Counts are mathematically related to smoke obscuration, and may be converted to the engineering unit of percent obscuration per foot, which will be recognized by those of ordinary skill in the art as a conventional measurement of smoke density or obscuration level. Each of the smoke detectors $\mathbf{110}_1$-$\mathbf{110}_a$ may be associated with a "baseline average value" that may be a periodically or continuously updated average of the output values of a smoke detector over time. The baseline average values of the smoke detectors $\mathbf{110}_1$-$\mathbf{110}_a$ may be calculated by a processor 127 of the alarm panel 120 and may be stored in a memory 128 of the alarm panel 120, for example. Alternatively, the baseline average values may be calculated by each smoke detector $\mathbf{110}_1$-$\mathbf{110}_a$ and communicated to the alarm panel 120.

An exemplary baseline average value for a smoke detector may be in a range of 50-150 counts, though the baseline average values of the smoke detectors $\mathbf{110}_1$-$\mathbf{110}_a$ may vary widely depending on the particular environments in which the smoke detectors $\mathbf{110}_1$-$\mathbf{110}_a$ are disposed. For example, smoke detectors that are located in environments that are normally relatively dirty (e.g., boiler rooms, gaming complexes, loading docks, etc.) may have relatively high baseline average values, while smoke detectors that are located in relatively clean environments (e.g., operating rooms, clean rooms, etc.) may have relatively low baseline average values. Additionally, if a smoke detector's surrounding environment becomes dirtier over time, the rate at which the baseline average value for that smoke detector increases may increase. Conversely, if a smoke detector's surrounding environment becomes cleaner over time, the rate at which the baseline average value for that smoke detector increases may decrease.

Each of the smoke detectors $\mathbf{110}_1$-$\mathbf{110}_a$ may additionally be associated with a predefined, operator-selectable "sensitivity value" that may be stored in the memory 128 of the alarm panel 120. The sensitivity value for a smoke detector may define a number of counts (e.g., 60 counts) above the baseline average value that is determined to be indicative of an alarm. Thus, the sum of the sensitivity value and the baseline average value for a smoke detector may yield an "alarm threshold value" for that smoke detector that may be calculated by the processor 127 of the alarm panel 120 and stored in the memory 128 of the alarm panel 120. During normal operation of the system 100, the alarm panel 120 may initiate an alarm if one or more of the smoke detectors $\mathbf{110}_1$-$\mathbf{110}_a$ generate an output value that is greater than its associated alarm threshold value. For example, if one of the smoke detectors $\mathbf{110}_1$-$\mathbf{110}_a$ is associated with a baseline average value of 100 counts and a sensitivity value of 50 counts (yielding an alarm threshold value of 150 counts), and that smoke detector outputs a value of 155 counts to the alarm panel 120, the alarm panel 120 may initiate an alarm.

The sensitivity values for the smoke detectors $\mathbf{110}_1$-$\mathbf{110}_a$ may be the same or may be different. For example, smoke detectors that are located in environments that are normally relatively dirty with highly variable levels of ambient, non-smoke particulate may be associated with relatively high sensitivity values to avoid nuisance alarms (i.e., alarms that are not attributed to actual alarm conditions). By contrast, smoke detectors that are located in relatively clean environments with stable levels of ambient, non-smoke particulate may be associated with relatively low sensitivity values so that alarm conditions are detected relatively quickly.

Still referring to FIG. 1, the alarm panel 120 may communicate alarm conditions and other data relating to the status of the alarm panel 120 and the smoke detectors $\mathbf{110}_1$-$\mathbf{110}_a$ to one or more monitoring entities 124 via an alarm reporting network 122. Examples of monitoring entities include, but are not limited to, various first responders (e.g., fire, police, EMT), as well as any $3^{rd}$ party alarm monitoring services that may be contracted to monitor and/or manage the system 100. Since it is critical that the system 100 be able to reliably communicate with the monitoring entities 124, the alarm reporting network 122 may be required to comply with numerous regulations and standards set forth by various regulatory bodies. Such regulations and standards may require that the alarm reporting network 122 include a hardwired connection, that it include redundant communication paths, that it use specific communication protocols, etc.

The smoke detectors $\mathbf{110}_1$-$\mathbf{110}_a$ of the system 100 may become dirty over time, such as may occur due to the accumulation of dirt, dust, and/or other particulate in the smoke detectors $\mathbf{110}_1$-$\mathbf{110}_a$. As discussed above, the dirtying of a smoke detector may cause its baseline average value to gradually increase over time. This will generally not affect the operation of a smoke detector, since the sensitivity value of a smoke detector remains unchanged unless it is modified by a technician. For example, if the smoke detector $\mathbf{110}_1$ of the system 100 has a baseline average value of 70 counts and is associated with a sensitivity of 60 counts, the smoke detector $\mathbf{110}_1$ will have an alarm threshold value of 130 counts (70 counts+60 counts=130 counts). If the smoke detector $\mathbf{110}_1$ becomes dirty over time, its baseline average value may gradually increase to 74 counts, for example, thereby causing its alarm threshold value to increase to 134 counts (74 counts+60 counts=134 counts). Thus, if the smoke detector $\mathbf{110}_1$ generates an output value that is more than 60 counts above its associated baseline average value it will result in an alarm regardless of whether the smoke detector $\mathbf{110}_1$ is relatively clean or relatively dirty.

Figure 2:
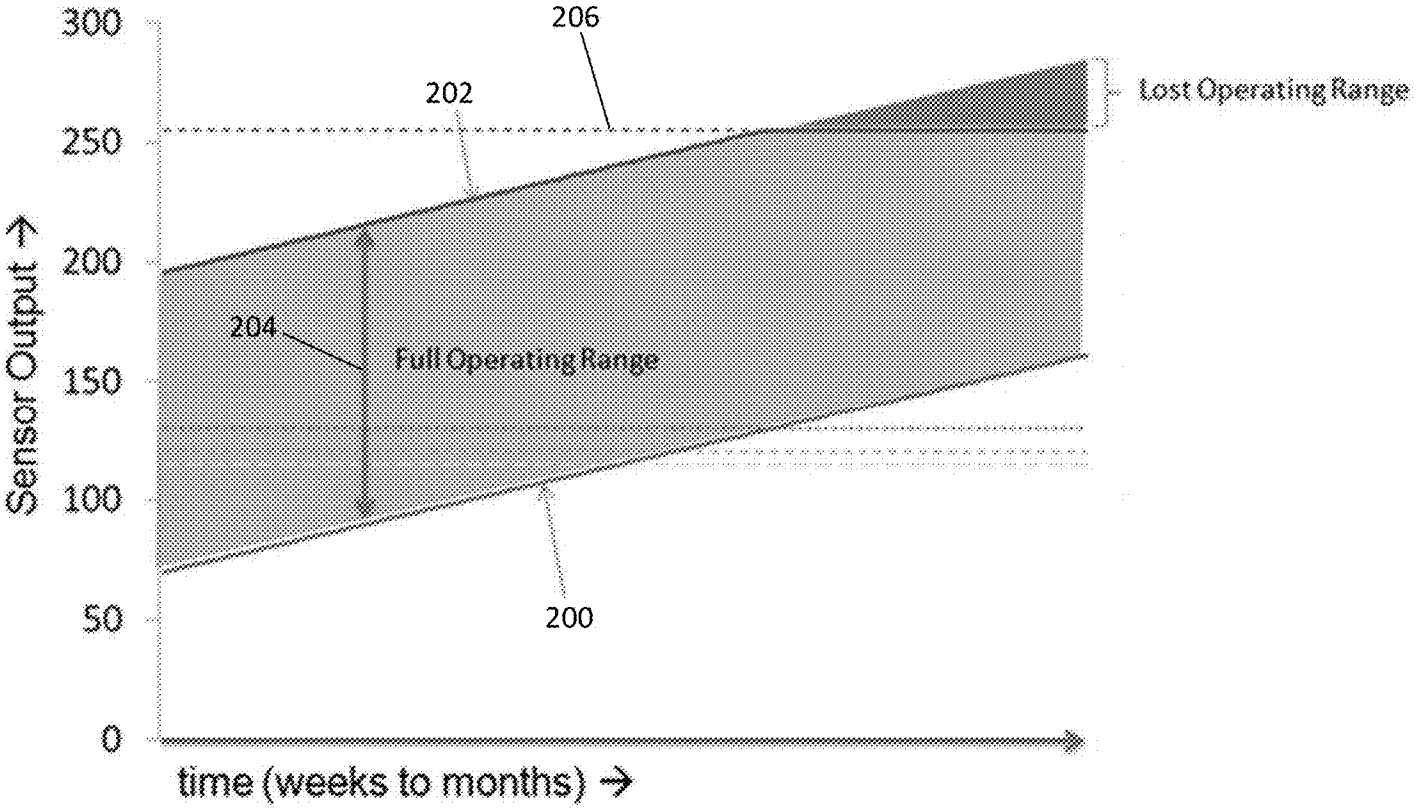
FIG. 2 is a line graph illustrating the baseline shift of a sensor over time and the subsequent impact on the alarm threshold and operating range of a smoke detector.

However, since the output value of each of the smoke detectors $\mathbf{110}_1$-$\mathbf{110}_a$ in the exemplary system 100 is in a range of 0-255 counts, there is an upper limit to how dirty a smoke detector may become before its effective operating range is diminished. This is illustrated in the exemplary graph presented in FIG. 2, which depicts the output of an exemplary smoke detector over time. As shown, the baseline average value 200 of the smoke detector gradually increases over time as the smoke detector becomes dirtier. Generally, the alarm threshold value 202 for the smoke detector may increase along with the baseline average value in a parallel fashion since the alarm threshold value is equal to the baseline average value plus the constant sensitivity value 204.

However, once the sum of the baseline average value 200 and the sensitivity value 204 exceeds the maximum output value 206 (i.e., 255 counts) of the smoke detector, the smoke detector will lose a portion of its effective operating range since an output value equal to the maximum output value 206 will always cause the alarm panel 120 to initiate an alarm. For example, if the baseline average value 200 of the smoke detector has increased to 145 counts and the smoke detector has a sensitivity value of 120 counts, the smoke detector will have lost 10 counts of operating range (145 counts+120 counts=265 counts; 10 counts in excess of the 255 count maximum). This may result in the increased occurrence of nuisance alarms since an increase in the output value of the smoke detector that is less than its sensitivity value 204 may result in an alarm. Additionally, if the smoke detector becomes extremely dirty, the baseline average value 200 may itself eventually reach the maximum output value 206 and cause an alarm.

In order to mitigate nuisance alarms and other detrimental effects of the smoke detectors $\mathbf{110}_1$-$\mathbf{110}_a$ of the system 100 becoming dirty overtime, the smoke detectors $\mathbf{110}_1$-$\mathbf{110}_a$ should be cleaned periodically so that their full effective operating ranges are preserved. In conventional fire safety systems, all smoke detectors are typically cleaned according to a regular schedule. This can be extremely tedious and time consuming, especially in fire safety systems that include dozens, hundreds, or even thousands of smoke detectors. The burden of this task can be reduced by identifying which smoke detectors in a fire safety system are actually dirty and are in need of cleaning as well as how well they were cleaned. However, operational data that facilitates identification of dirty smoke detectors is typically stored in the alarm panels of a fire safety system, which are themselves often numerous, widely distributed, and difficult to access.

Referring again to FIG. 1, the system 100 of the present disclosure addresses the above-described challenges by facilitating convenient identification of smoke detectors that require, or will soon require, cleaning. Particularly, the alarm panel 120 of the present disclosure may be provided with a data communication device 129 that may be configured to communicate specified operational data from the alarm panel 120 (e.g., from the memory 128 of the alarm panel 120), wherein such operational data may include, but is not limited to, a historical log of output values, peak values, baseline average values, and sensitivity values for each of the smoke detectors $\mathbf{110}_1$-$\mathbf{110}_a$. The data communication device 129 may further be configured to format the communicated operational data in a desired manner (e.g., text, xml, etc.) and to transmit the operational data over an analytics network 130 to facilitate a comprehensive performance analysis of the smoke detectors $\mathbf{110}_1$-$\mathbf{110}_a$ as further described below. The data communication device 129 may be an integral software and/or hardware component of the alarm panel 120 that may be installed during manufacture of the alarm panel 120, or the data communication device 129 may be a separate software and/or hardware component that may be added to an existing alarm panel that is already installed in the field (e.g., by connecting the data communication device 129 to a conventional data port of an alarm panel).

Advantageously, the analytics network 130 over which the operational data is transmitted from the alarm panel 120 via the data communication device 129 may be entirely separate and independent from the alarm reporting network 122. Thus, since the analytics network 130 is not necessary for facilitating communication with the monitoring entities 124, the analytics network 130 may not be subject to the stringent regulatory requirements that may apply to the alarm reporting network 122 as described above. The analytics network 130 may therefore be implemented, maintained, and modified more easily and at a lower cost relative to the alarm reporting network 122. For example, the analytics network 130 may be implemented using any of a variety of conventional networking technologies that will be familiar to those skilled in the art, including, but not limited to, a packet-switched network (e.g., public networks such as the Internet, private networks such as an enterprise intranet, and so forth), a circuit-switched network (e.g., a public switched telephone network), or a combination of a packet-switched network and a circuit-switched network with suitable gateways and translators. The analytics network 130 may be partially or entirely defined by wireless communication paths, such as may be implemented using 3G, 4G, Wi-Fi, WiMAX or other wireless technologies known to those in the art. In some embodiments of the system 100, the operational data may be transmitted over the analytics network 130 securely, for example by using Advanced Encryption Standard (AES) over Hypertext Transfer Protocol Secure (HTTPS).

The data communication device 129 may include a processor that is configured to run a software agent that, upon receiving a request from a remote services server 140, may capture, package, and encrypt the operational data that is output by the alarm panel 120. The data communications device 129 may then transmit the operational data over the analytics network 130 to the remote services server 140. The remote services server 140 may be configured to capture the operational data and to parse and store the operational data in a database. The remote services server 140 may further be configured to transmit the database containing the parsed operational data over the analytics network 130 to the applications server 150 that may process the operational data as further described below. Alternatively, the remote services server 140 may transmit the database to the applications server 150 over a communications path that is separate from the analytics network 130, or the data communication device 128 may simply transmit the operational data from the alarm panel 120 directly to the applications server 150, omitting the remote services server 140.

The remote services server 140 may be configured to issue requests for operational data to the data communication device 129 according to a predetermined schedule that may be defined by a technician. For example, the remote services server 140 may be configured to issue requests for operational data on a monthly, weekly, daily, or hourly basis depending on the type of analytics that are to be performed with the data (described in greater detail below). In one example, the remote services server 140 may be configured to issue requests for operational data to the data communication device 129 with relatively greater frequency to facilitate the performance of peak analytics (described below), and may be configured to issue requests for operational data to the data communication device 129 with lower frequency to facilitate the performance of trend analysis (described below).

The applications server 150 may be configured to parse the operational data received from the remote services server 140 and to perform various analytics on the operational data in order to make various determinations relating to the operational performance of the smoke detectors $\mathbf{110}_1$-$\mathbf{110}_a$. Such determinations may include, but are not limited to, how dirty each of the smoke detectors $\mathbf{110}_1$-$\mathbf{110}_a$ is and whether each of the smoke detectors $\mathbf{110}_1$-$\mathbf{110}_a$ requires, or will soon require, cleaning. For example, as described in greater detail below, the applications server 150 may use the operational data to perform an average value assessment, a directional vector assessment, short-, mid-, and long-term trend assessments, and to perform peak analytics to facilitate optimization of the arrangement and/or configuration of the smoke detectors $\mathbf{110}_1$-$\mathbf{110}_a$ in the system 100.

Average Value Assessment

The applications server 150 may use the operational data to perform an average value assessment to determine how dirty each of the smoke detectors $\mathbf{110}_1$-$\mathbf{110}_a$ in the system 100 is. This may be achieved by comparing the baseline average values associated with each of the smoke detectors $\mathbf{110}_1$-$\mathbf{110}_a$ to predefined dirtiness threshold levels that may be used to categorize various levels of smoke detector dirtiness. For example, the dirtiness threshold levels may include an "Almost Dirty" or similarly labeled level at 115 counts, a "Dirty" or similarly labeled level at 120 counts, and an "Excessively Dirty" or similarly labeled level at 125 counts. A greater or fewer number of dirtiness threshold levels may be implemented without departing from the present disclosure. If a smoke detector in the system 100 has a baseline average value that breeches (i.e., exceeds) one or more of the predefined dirtiness threshold levels, the applications server 150 may flag that smoke detector accordingly for subsequent presentation to a technician as further described below. The technician may then take appropriate actions to clean the flagged smoke detectors, and may address the smoke detectors in the Excessively Dirty and Dirty categories more urgently than those categorized as Almost Dirty, for example.

Directional Vector Assessment

The applications server 150 may use the operational data to derive directional vectors for each of the smoke detectors $\mathbf{110}_1$-$\mathbf{110}_a$ in the system 100. This may be useful for determining how well a smoke detector has been cleaned as well as for determining when, and to what extent, environmental factors have affected the output of a smoke detector. A directional vector for a smoke detector may be derived by subtracting a first output value of the smoke detector generated at a first time from a second output value of the smoke detector generated at a second time after the first time. An equation for calculating a directional vector may be as follows:

$$DirectionalVector = \frac{Count_{Second} - Count_{First}}{Time_{Second} - Time_{First}}$$

Every count value is sent with a timestamp. It is therefore possible to calculate the difference in time between the timestamps of different counts and generate a ratio or rate of change. When performing these calculations, it is important to use the same unit of measurement for differences in time. Depending on the application, different measurement granularity might be appropriate. For example, in cases where the smoke detector is installed in locations with rapid changes in the amount of airborne particulate, a measurement in seconds or minutes may be appropriate, but in locations with less rapid changes a measure in days or weeks may be more appropriate. In the examples discussed below, the difference is measured in minutes.

Large negative vectors may be associated with the cleaning of a smoke detector, while large positive vectors may be associated with the testing of a smoke detector or real alarm conditions. Thus, a large negative vector (e.g., −25 counts/min) that is derived from first and second output values generated by a smoke detector before and after cleaning of the smoke detector, respectively, may indicate that the smoke detector was cleaned well. Conversely, a small negative vector (e.g., −5 counts/min) that is derived from first and second output values generated by a smoke detector before and after cleaning of the smoke detector, respectively, may indicate that the smoke detector was cleaned poorly. A miniscule vector (e.g., no measured change in the count) may be indicative of improper installation of a smoke detector (e.g., a dust cover was not removed from a smoke detector during installation, thereby preventing the smoke detector from collecting ambient particulate), or an error in data collection. Smoke detectors that are associated with such miniscule vectors may be flagged for inspection and can be assessed using associated trends (described in detail below).

The applications server 150 may derive directional vectors for each of the smoke detectors $\mathbf{110}_1$-$\mathbf{110}_a$ in the system 100 for subsequent presentation to a technician as further described below. The technician may use directional vectors to determine whether any actions should be taken, such as re-cleaning or replacing smoke detectors that have small negative vectors after an initial cleaning, for example.

Positive directional vectors are expected to rise at a rate that is consistent with an environment in which a smoke detector is installed. Thus, during normal operating conditions, the average vector for a site (i.e., the average of all directional vectors for smoke detectors located at a particular site) can be used as a reference point for that site. Detectors showing positive vectors above the site calculated average vector may have placement or application issues, or may simply be disposed in areas that are dirtier than other smoke detectors located in the same site. Regardless, smoke detectors that are associated with directional vectors that significantly deviate from the average vector may be flagged as potential outliers so that they can be evaluated further. The results of testing and cleaning such outlying smoke detectors may be omitted from trend analyses (described below) to prevent skewing of data.

Short, Medium, and Long-Term Trend Assessments

The directional vectors discussed above can be used to make predictions regarding near and long term operation of smoke detectors in the system 100. For example, a directional vector can be calculated from the initial installation of a smoke detector until a most recent count value is obtained. Assuming that this directional vector is the general rate at which the smoke detector accumulates dirt, dust, and other particulate, the directional vector can be extrapolated to predict when the smoke detector will become Almost Dirty, Dirty, and Excessively Dirty. One problem with this method is that it fails to account for sudden changes in count values. For example, if a smoke detector were in operation for several weeks (gathering dirt in the process), then cleaned, and then shortly afterwards a directional vector for that smoke detector is calculated, the result would be a small change in count divided by a large change in time. This small change in count would not be an accurate reflection of the device's general propensity to gather dirt over time. As a result, using this trend to predict when the smoke detector will become Almost Dirty, Dirty, or Excessively Dirty would likely produce an inaccurate result.

In accordance with the present disclosure, two approaches may be used to provide an accurate prediction of when smoke detectors in the system 100 will breech predefined dirtiness threshold levels. As a first approach, an inflection point may be calculated for each smoke detector. As a second approach, at least three trends may be calculated, which may include, but are not limited to, short-, mid- and long-term trends. An inflection point may be calculated by identifying a large negative change in counts, which may be indicative of a recent cleaning or replacement of a smoke detector. Trends are calculated for the smoke detector after the inflection point, meaning they generally reflect dirt accumulation after cleaning or replacement. Also, since at least three distinct trends are calculated, they can be compared with one another. If the three trends generally align, then it is likely that the trend calculations generally reflect environmental conditions. If the short-, mid- and long-term trends are significantly distinct, then differences may be due to sudden changes that are not attributable to general environmental conditions.

For ease of computation, values may be stored as "deltas," where ΔCount represents a change in count and ΔTime represents a change in time. This assists in computation because a smoke detector sensitivity may be defined in terms of a delta. For example, with a fixed ΔTime value, a ΔCount value of 60 may trigger an alarm. Storing values as deltas may simplify programmatic implementation across multiple sensors because the alarm panel may only need to implement a single computation for each sensor: IF ΔCount≥60 THEN trigger the alarm. To improve computation speed, an inflection point may be calculated based upon finding a large ΔCount value without taking into account accompanying ΔTime values.

A short-term trend may be calculated for a smoke detector by summing 2–4 ΔCount values (where the first value may be shortly after an inflection point) and dividing the result by the sum of their accompanying ΔTime values. This may be expressed in summation notation as follows, where i is the index of summation and n is between 2 and 4.

$$Trend_{ShortTerm} = \frac{\sum_i^n \Delta Count_i}{\sum_i^n \Delta time_i}$$

-continued $$\text{Site } Trend_{Short\ Term} = \frac{\sum_i^n Trend_{Short\ Term_i}}{\text{number of devices}}$$

The short term trend may provide a better representation of the rate of change in count values (and hence the dirtiness of a smoke detector) than a directional vector. A site trend may be calculated by calculating the average short-term trend value for each smoke detector in a site. A site may include, for example, an area of a building. Site trends may be useful because they may provide insight into which areas accumulate dirt more quickly than other areas.

Mid-term Trends (sometimes referred to as "medium" trends) may be calculated in using more data points (for example, 4 to 10 data sets covering about four weeks of time). There is typically less variation in mid-term trends compared to short-term trends because they incorporate more data, hence minor aberrances do not influence the overall calculation as profoundly as they influence short-term trends. Mid-term trends may be calculated using more advanced data-processing algorithms, for example linear, quadratic or cubic regression. An R-squared (RSQ) assessment may also be calculated. A high RSQ value means that the smoke detector is generally accumulating dirt in a regular, predictable manner, but a low RSQ value may indicate more severe fluctuations in the level of dirt accumulation. Mid-term trends may also start at the inflection points discussed above with respect to the short-term trends. Directional vectors may be used to determine a good stopping point. For example, a large directional vector may indicate an abnormal change in the status of the smoke detector which should not be taken into account as part of a trend.

Long-term trends may be derived from longer data sets than short- or mid-term trends. Long-term trends may include all data from an inflection point to the most recent data set. For example, long-term trends may use 8 to 12 data points and cover at least 8 weeks of data. Long-term trends may use advanced algorithms such as linear, quadratic or cubic regression analysis discussed above with reference to mid-term trends. Generally, quadratic and cubic analysis will only be performed in cases where the RSQ coefficient is low for linear regression.

The combination of the three trends may be used to convey the status of the smoke detector to a client (e.g., a technician) via the web portal server 160. For example, correlation of short, medium and long-term trends indicates stability and improves confidence in predicting the Almost Dirty, Dirty and Excessively Dirty breach dates. As an example, the Almost Dirty date can be predicted using linear equations by taking the long-term trend (count per minute), the average value and the almost dirty threshold to determine a time differential, then adding the time differential to the current date:

$$\text{Breach } Date_{AD} = \left[\frac{\text{Almost Dirty Limit} - \text{Average Value}}{\text{Trend}\left(\frac{\text{counts}}{\text{min}}\right) \times 1440\left(\frac{\text{min}}{\text{day}}\right)}\right] + \text{Current Date}$$

In the above equation, "Trend" can be one of the short-, mid- or long-term trend calculations discussed above. Preferably, the long-term trend having the most recently collected data will be used. Similar calculations are performed for the calculation of the Dirty (D) and Excessively Dirty (XD) dates:

$$\text{Breach } Date_D = \left[\frac{\text{Dirty Limit} - \text{Average Value}}{\text{Trend}\left(\frac{\text{counts}}{\text{min}}\right) \times 1440\left(\frac{\text{min}}{\text{day}}\right)}\right] + \text{Current Date}$$

$$\text{Breach } Date_{XD} = \left[\frac{\text{Excess Dirty Limit} - \text{Average Value}}{\text{Trend}\left(\frac{\text{counts}}{\text{min}}\right) \times 1440\left(\frac{\text{min}}{\text{day}}\right)}\right] + \text{Current Date}$$

The above equations can be used in cases where the trend is calculated by linear regression. These equations would need to be adapted for use with other algorithms, for example quadratic or cubic regressions.

Peak Analytics

The applications server 150 may additionally use the operational data to perform peak analytics for determining appropriate smoke detector sensitivity settings. Peak analytics may be performed by examining the highest count value ("peak") for each smoke detector connected to an alarm panel during a given time period. The peak may be calculated by, for example, the alarm panel 120, the data communication device 129, the remote services server 140, or the applications server 150.

Peak analytics may involve calculating each peak value as a percentage of an alarm value associated with a smoke detector and determining each peak's statistical repeatability. If the peak associated with a smoke detector is calculated as a percentage of the smoke detector's alarm value, and the peak is regularly traversing a threshold value (for example, 70% of the alarm value) then there is an increased risk that the smoke detector will produce an alarm due to the local environment and not necessarily smoke, a phenomenon referred to as a "nuisance alarm." A similar inference can be made if the mean of the peak (calculated as a percentage of the alarm value) is above 50%. An alarm caused by factors other than smoke may disrupt business operations and cost the business in lost time, production and possibly fines or damages on contracts. Accordingly, determining in advance that a nuisance alarm is likely may be useful. The peak assessment process may not be able to determine what the exact problem is, but may indicate that the risk level for a nuisance alarm is escalated and needs to be assessed. An onsite review of the smoke detector placement, local environment, sensitivity setting and/or application may need to be performed in order to determine the reason for the escalated risk. Reasons for escalated risk may include, but are not limited to, the smoke detector being too close to an air vent, a misapplication, or a sensitivity being set is too aggressively for the location in which a smoke detector is applied. As a precautionary step, the system may be configured such that upon identifying smoke detectors with high nuisance alarm probabilities, the application server 150 or the remote services server 140, using the analytics network 130, may send the alarm panel 120 new sensitivity settings for the affected smoke detectors 110, thus reducing the possibility of a nuisance alarm and giving a technician time to investigate a particular application in detail. This update may be performed via the data communication device 129, which may receive the update via the analytics network 130, may parse the update, and may apply the update to the alarm panel 120.

It is helpful to know whether a peak value for a smoke detector is out-of-the-ordinary or generally repeatable, especially in cases where a peak value as a percentage of an alarm value is very low (for example, below 20%) and changing the sensitivity to improve response time is desired or is being considered. Appropriate statistical analytics may be calculated by assuming that the peak is the output of a process and plotting the peak against a 3Sigma (3Σ) deviation chart of that process. By calculating a Standard Deviation of the Peak values and multiplying this calculated value by three, a 95% confidence level around the mean of each smoke detector can be calculated. If individual peak values remain inside this 3Σ window over multiple data sets, then this peak can be deemed very reliable. This reliability level can be conveyed to a user, for example via web portal server 160, along with a sensitivity adjustment recommendation. In addition or alternatively, a control directive may be transmitted directly to the alarm panel 120 to adjust the sensitivity for a smoke detector. For example, a control directive may be sent by the applications server 150 via the analytics network 130.

As discussed above in reference to short-term trends, sensitivity settings for each smoke detector are based on a fixed ΔCount value. Consequently, each smoke detector can be mathematically tested for other sensitivity settings. This process first entails calculating the difference between the peak value and the average value. A "% of range" value can then be calculated by dividing this difference by the operating range of the smoke detector. If this calculation is performed for all possible sensitivities, then a preview of how the smoke detector will perform if set to any of the other possible sensitivity settings can be generated. This preview may be presented to a user via the web portal server 160, and the sensitivity of the smoke detector may be adjusted accordingly.

Referring again to FIG. 1, the system 100 may further include a web portal server 160 that is configured to receive the results of the above-described analytics, including the average value assessment, the directional vector assessment, the short-, mid-, and long-term trend assessments, and the peak analytics, from the applications server 150 via the analytics network 130. Alternatively, the web portal server 160 may receive the results over a communications path that is separate from the analytics network 130. The web portal server 160 may be configured to format the received results and to make the formatted results available to a technician or other system operator via a network interface on a client device 170, such as a laptop computer, desktop computer, tablet computer, personal data assistant (PDA), smart phone, etc. The results may be presented as raw data (e.g., in an alphanumeric format) or in a graphical format that can be readily and conveniently reviewed by the technician.

Figure 3:
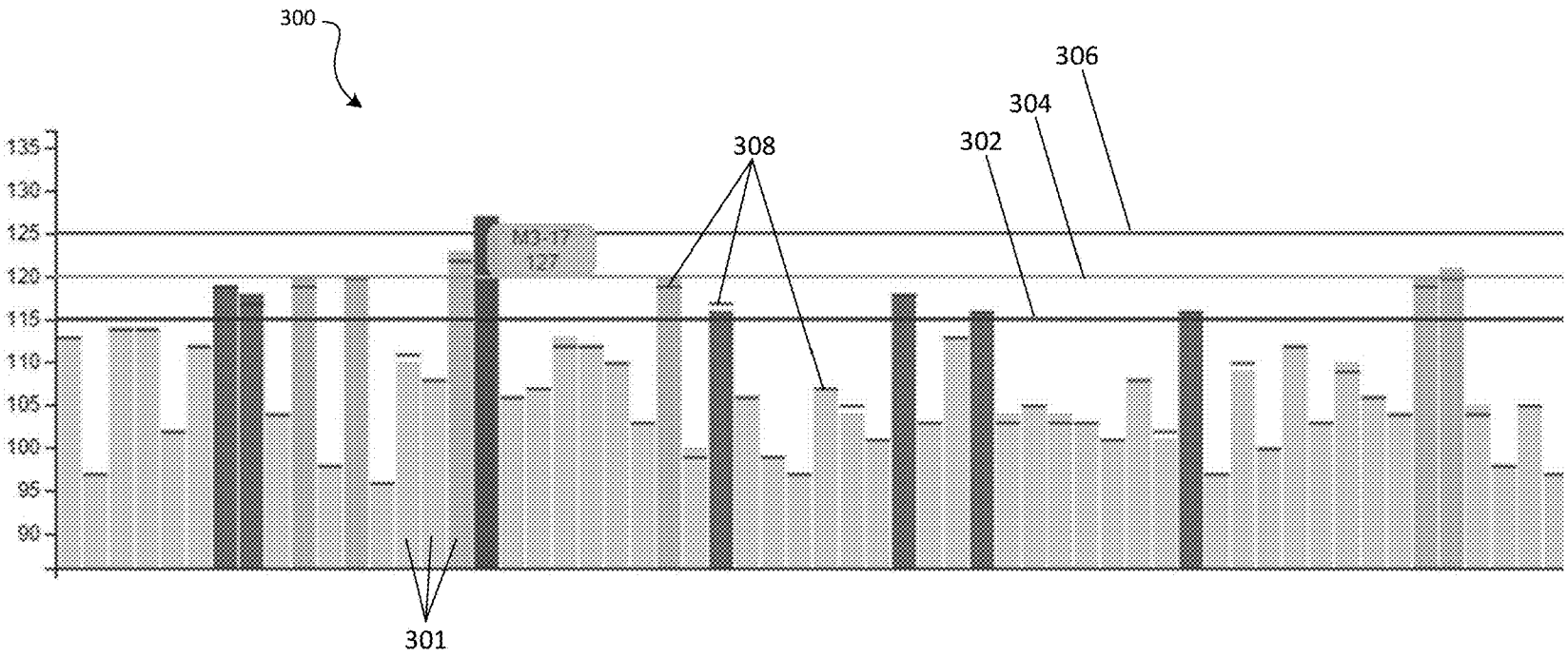
FIG. 3 is a bar graph illustrating an exemplary representation of the results of an average value assessment performed in accordance with the present disclosure.

In the non-limiting example shown in FIG. 3, the results of the above-described average value assessment performed by the applications server 150 may be presented on the client device 170 (FIG. 1) in the form of a vertical bar graph 300, for example, wherein each of the bars 301 may represent a baseline average value associated with one of the smoke detectors $\mathbf{110}_1$-$\mathbf{110}_a$ in the system 100, and the vertical axis of the bar graph 300 may represent a range of counts (e.g., 85–137 counts). Thus, the taller that a bar 301 is in the bar graph 300, the dirtier that the associated smoke detector is in the system 100.

The bar graph 300 may include a plurality of horizontally extending "dirtiness threshold lines" 302, 304, 306 at different count values that are associated with the predefined dirtiness threshold levels (described above) of the system 100. For example, the lowest dirtiness threshold line 302 in the bar graph 300 may be at 115 counts and may be associated with the Almost Dirty level. The next highest dirtiness threshold line 304 in the bar graph 300 may be at 120 counts and may be associated with the Dirty level. The highest dirtiness threshold line 306 in the bar graph 300 may be at 125 counts and may be associated with the Excessively Dirty level. Thus, if a bar 301 in the bar graph 300 reaches or exceeds one of the horizontally extending lines 302-306, the smoke detector that is associated with that bar 301 may be determined to fall into a corresponding dirtiness category and may be determined to require commensurate attention (e.g., immediate or future cleaning).

Each of the bars 301 in the bar graph 300 may further include a "prior baseline average indicium" 308, such as a short horizontally extending line or other indicia disposed on or above each bar, that indicates a baseline average value from a most recent prior average value assessment for each of the smoke detectors $\mathbf{110}_1$-$\mathbf{110}_a$. Thus, if a prior baseline average indicium 308 is above located above a top of its corresponding bar 301, it may indicate that the associated smoke detector is cleaner than it was at the most recent prior average value assessment. Conversely, if a prior baseline average indicium 308 is located below the top of its corresponding bar 301, it may indicate that the associated smoke detector is dirtier than it was at the most recent prior average value assessment.

Figure 4:
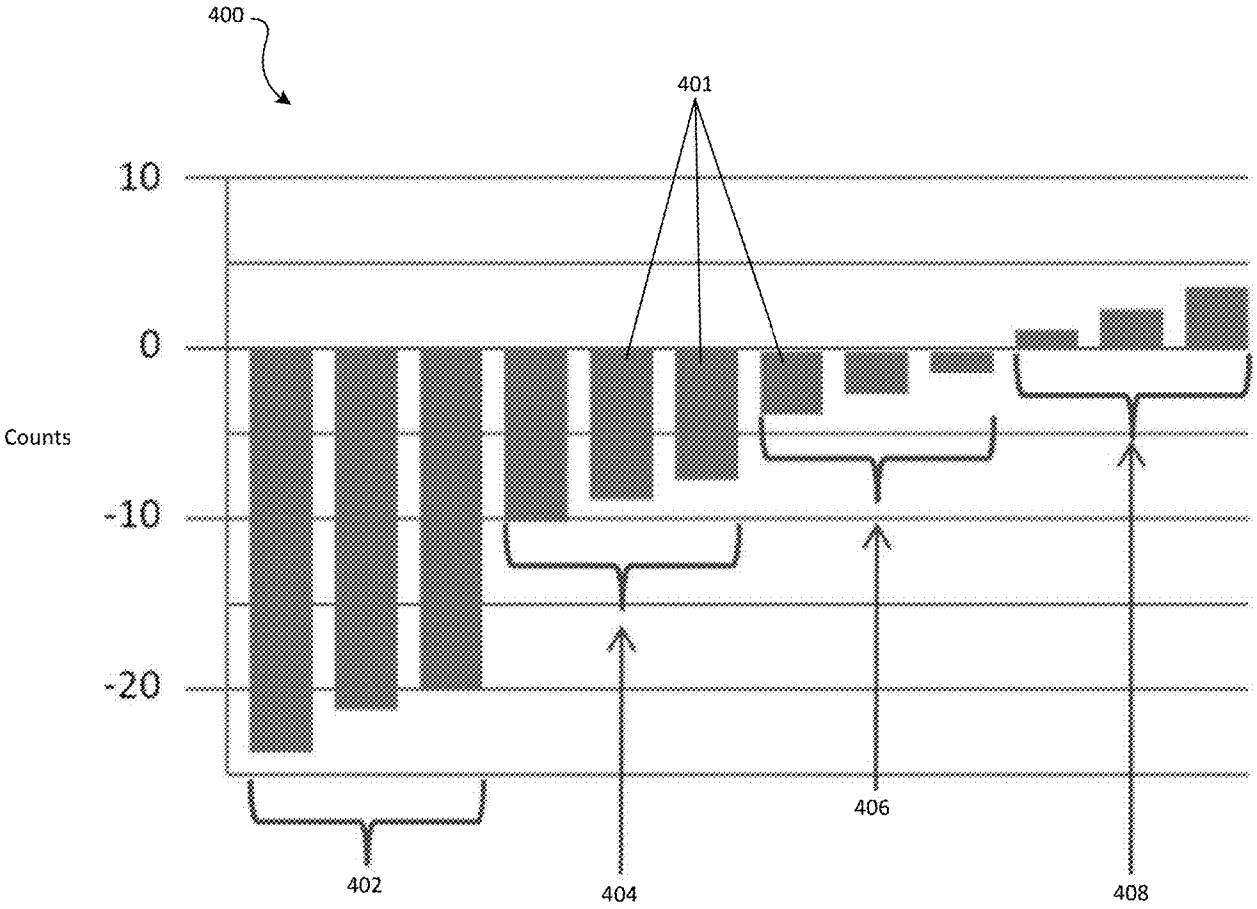
FIG. 4 is a bar graph illustrating an exemplary representation of the results of a directional vector assessment performed in accordance with the present disclosure.
Figure 5:
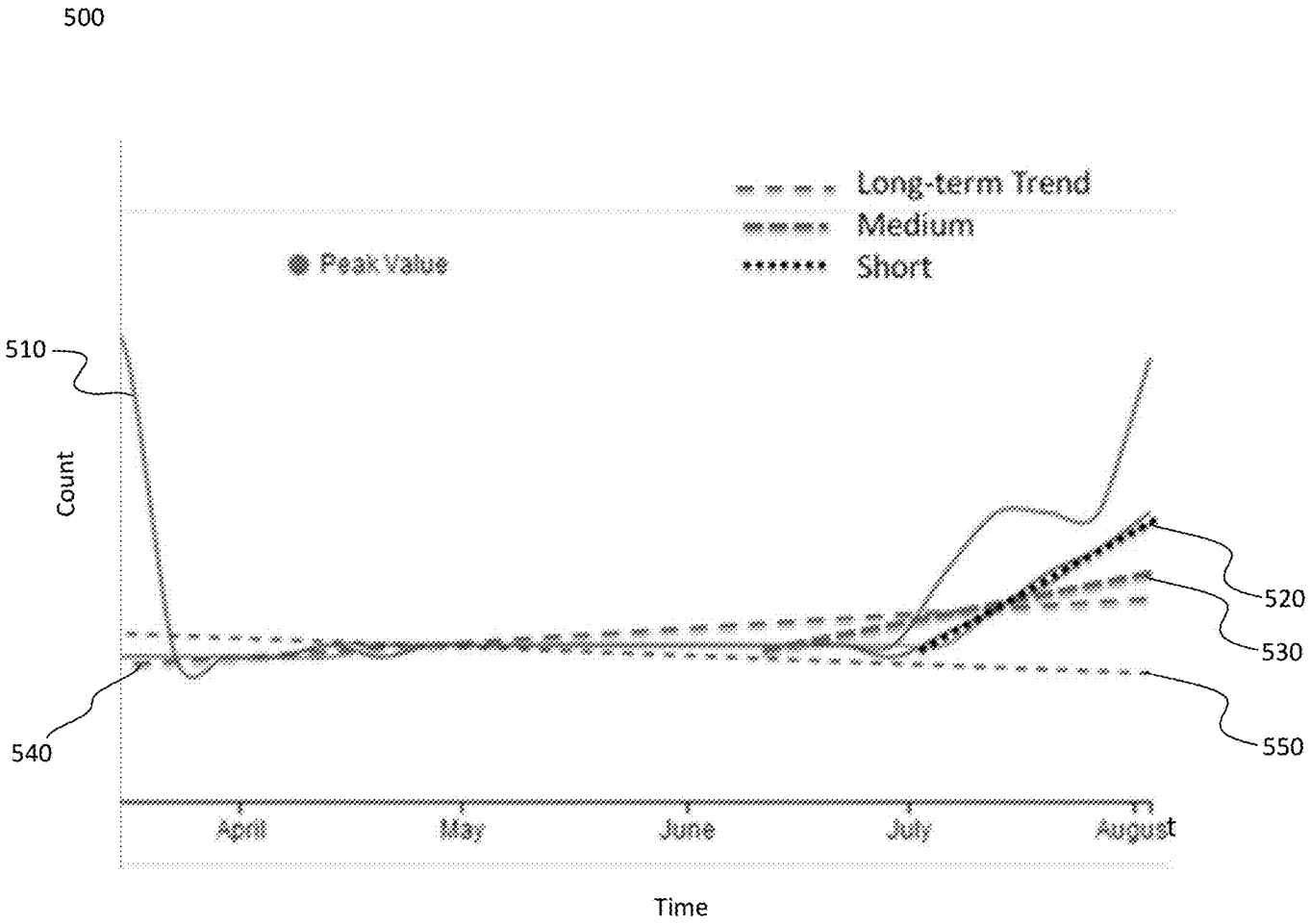
FIG. 5 is a line graph illustrating an exemplary data representation of the results of peak analytics as well as short-, mid- and long-term trend calculation performed in accordance with the present disclosure.

In the non-limiting example shown in FIG. 4, the results of the above-described directional vector assessment performed by the applications server 150 may be presented on the client device 170 (FIG. 1) in the form of a vertical bar graph 400, for example, wherein each of the bars 401 may represent a directional vector associated with one of the smoke detectors $\mathbf{110}_1$-$\mathbf{110}_a$ in the system 100, and the vertical axis of the bar graph 400 may represent a range of counts (e.g., −25 counts to 10 counts). As described above, large negative vectors may be associated with smoke detectors that have been cleaned well, small negative vectors may be associated with smoke detectors that have been cleaned poorly, and positive vectors may be associated with smoke detectors that have become dirtier. Thus, the first group 402 of three bars 401 in the exemplary bar graph 400, which extend to −20 counts or below, may be associated with smoke detectors that have been cleaned very well; the second group 404 of three bars 401 in the bar graph 400, which extend to between −5 and −10 counts, may be associated with smoke detectors that have been cleaned somewhat well; the third group 406 of three bars 401 in the bar graph 400, which extend to between 0 and −5 counts, may be associated with smoke detectors that have been cleaned poorly; and the fourth group 408 of three bars 401 in the bar graph 400, which extend to between 0 and 5 counts, may be associated with smoke detectors that have not been cleaned (i.e., have become dirtier). Results may also be presented in graphical form as shown in FIG. 5. FIG. 5 shows a graphical representation 500 having a peak value 510, a short-term trend 520, a mid-term trend 530, a first long-term trend 540, and a second long-term trend 550 are shown. The peak value 510 incorporates peak data for the entire period represented by the graphical representation 500. The short-term trend 520, by contrast, incorporates only data from July through August. The mid-term trend incorporates data from the middle of June through August.

The first long-term trend 540 is calculated from the inflection point at the beginning of April, whereas the second long-term trend 550 is calculated using all data in the smoke detector history log. The sudden decrease in peak values prior to April is likely due to a cleaning. The increases in peak values after July are likely due to a change in environmental conditions (for example, construction may have begun which kicked up dirt). The graphical representation 500 illustrates the importance of correctly calculating inflection points. The second long-term trend 550 shows an overall decrease in count values despite the post-July increases because it takes into account data from before the cleaning. The second long-term trend 550 would therefore not be useful in making predictions.

The slope of the short-term trend 520 is greater than the slope of the mid-term trend 530, and they are both greater than the slope of the first long-term trend 540. This indicates that the increase in count values from July onward may be due to transient environmental conditions which do not generally reflect the rate at which the device accumulates dirt.

Data and predictions may also be presented in chart form, as shown in FIG. 6. A chart 600 may include a dirty detectors grouping 610 (indicating devices currently dirty and in need of servicing) and a predicted detectors grouping 620 (indicating devices predicted to breach the Almost Dirty, Dirty, and Excessively Dirty thresholds in the future.

The dirty detectors grouping 610 may include a channel column 611, a device number column 612, a custom label column 613 and an average value column 614. The channel column 611 may indicate the channel used for communication, for example an IDNet channel that represents the physical connection between the smoke detector (110) and the alarm panel (120). The device number column 612 may indicate a unique identification number (on the previously noted channel) associated with the device. The custom label column 613 may indicate a custom label assigned to the device which often describes the location of the smoke detector. The average value column 614 may indicate, for example, a current average value (discussed above).

The predicted detectors grouping 620 may include a channel column 621, a device number column 622, a custom label column 623, an almost dirty column 624, a dirty column 625, and an excessively dirty column 626. The channel column 621 may indicate the channel used for communication, for example an IDNet channel. The device number column 622 may indicate an identification number associated with the device. The custom label column 623 may indicate a custom label assigned to the device. The almost dirty column 624 may indicate a predicted date on which the device will breach the Almost Dirty threshold. The dirty column 625 may indicate a predicted date on which the device will breach the Dirty threshold. The Excessively Dirty column 626 may indicate a predicted date on which the device will breach the Excessively Dirty threshold. These predictions may be generated based on the short-, mid- or long-term trends as discussed above in the section entitled "Short, Medium, and Long-Term Trend Assessments."

It will be appreciated that the above-described graphical and chart-based representations of the results of the analytics performed by the applications server 150, as presented by the client device 170, may allow technicians and other system operators to accurately, quickly and conveniently identify smoke detectors $\mathbf{110}_1$-$\mathbf{110}_a$ in the system 100 that are in need of cleaning, reconfiguration (e.g., adjustment of sensitivity values), and/or repositioning within a monitored site to improve reliable and nuisance-free operation of the system 100.

While the system 100 has been described as having a remote services server 140, an applications server 150, and a web portal server 160 that are separate from one another, it is contemplated that the functions performed by two or more of these servers may alternatively be performed by a single server.

Figure 7:
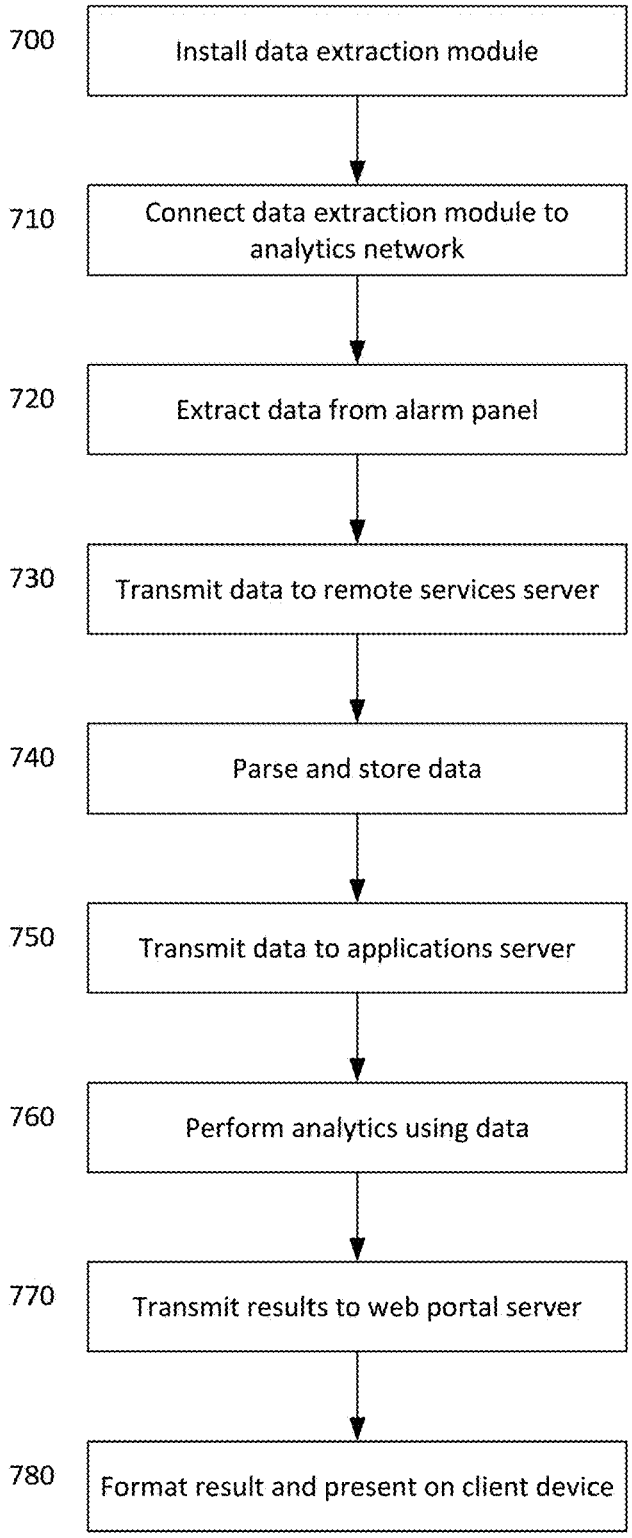
FIG. 7 is a flow diagram illustrating an exemplary embodiment of a method for performing smoke detector performance analysis in accordance with the present disclosure.

Referring to FIG. 7, a flow diagram illustrating an exemplary method for implementing the above-described system 100 in accordance with the present disclosure is shown. Such method will be described in conjunction with the schematic representation of the system 100 shown in FIG. 1.

At step 700 of the exemplary method, the data communication device 129 may be installed in the alarm panel 120, either during manufacture of the alarm panel 120 or at some time thereafter. For example, data communication device 129 may be installed in the alarm panel 120 after the alarm panel 120 has been installed in a monitored site, such as by connecting the data communication device 129 to a conventional data port of the alarm panel 120. At step 710 of the method, the data communication device 129 may be connected to the data analytics network 130, which may be separate from, and maintained independently of, the alarm reporting network 122 as described above.

At step 720 of the exemplary method, the data communication device 129 may extract operational data from the alarm panel 120 (e.g., from the memory 128 of the alarm panel 120) and may format the operational data in a desired manner (e.g., text, xml, etc.). The extracted operational data may include, but is not limited to, a historical log of output values, baseline average values, and sensitivity values for each of the smoke detectors $\mathbf{110}_1$-$\mathbf{110}_a$ in the system 100. At step 730 of the method, the data communication device 129 may transmit the operational data over an analytics network 130 to the remote services server 140. Steps 720 and 730 may be performed by the data communication device 129 automatically as according to a predefined schedule, or may be performed by the data communication device 129 in response to receiving a manually or automatically initiated request from the remote services server 140.

At step 740 of the exemplary method, the remote services server 140 may parse the received operational data and may store the parsed data in a database. At step 750 of the method, the remote services server 140 may transmit the database containing the parsed operational data to the applications server 150, or may simply make the database accessible to the applications server 150.

At step 760 of the exemplary method, the applications server 150 may perform various analytics using the operational data to yield information indicating how dirty the smoke detectors $\mathbf{110}_1$-$\mathbf{110}_a$ of the system 100 are, if any of the smoke detectors $\mathbf{110}_1$-$\mathbf{110}_a$ require cleaning and/or when in the future the smoke detectors $\mathbf{110}_1$-$\mathbf{110}_a$ will require cleaning, if the sensitivity values of any of the smoke detectors $\mathbf{110}_1$-$\mathbf{110}_a$ should be adjusted, and whether any of the smoke detectors $\mathbf{110}_1$-$\mathbf{110}_a$ should be moved to a different location within a monitored site. The analytics performed by the applications server 150 may include, but are not limited to, an average value assessment, a directional vector assessment, short, medium, and long-term trend assessments, and peak analytics as described above.

At step 770 of the exemplary method, the results of the analytics performed by the applications server 150 may be transmitted to, or may be made accessible to, the web portal server 160. At step 780 of the method, the web portal server 160 may format the results in a desired manner and may make the formatted results accessible to the client device 170 where they may be presented for review by a technician or other system operator. Based on the results, the technician may determine how dirty the smoke detectors $\mathbf{110}_1$-$\mathbf{110}_a$ of the system 100 are, if any of the smoke detectors $\mathbf{110}_1$-$\mathbf{110}_a$ require cleaning and/or when in the future the smoke detectors $\mathbf{110}_1$-$\mathbf{110}_a$ will require cleaning, if the sensitivity values of any of the smoke detectors $\mathbf{110}_1$-$\mathbf{110}_a$ should be adjusted, and whether any of the smoke detectors $\mathbf{110}_1$-$\mathbf{110}_a$ should be moved to a different location within a monitored site.

It will be appreciated from the foregoing disclosure that the system 100 and method described herein allow technicians and other fire safety system operators to accurately, quickly and conveniently determine whether and when smoke detectors in a fire safety system are in need of, or may benefit from, cleaning, adjustment, and/or reconfiguration. The system 100 and method allow such determinations to be made remotely without requiring technicians to physically visit individual smoke detectors and/or alarm panels in fire alarm systems. Furthermore, the system 100 and method may be implemented using communications networks that are separate and independent from conventional alarm reporting networks and are therefore not be subject to the stringent regulatory requirements that normally apply to such alarm reporting networks. All of the aforementioned advantages provide significant time and cost savings and allow fire safety systems to be maintained in more efficient, reliable, and nuisance-free manner.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

The various embodiments or components described above, for example, the data communication device 129, the remote services server 140, the applications server 150, the web portal server 160, and the components or processors therein, may be implemented as part of one or more computer systems. Such a computer system may include a computer, an input device, a display unit and an interface, for example, for accessing the Internet. The computer may include a microprocessor. The microprocessor may be connected to a communication bus. The computer may also include memories. The memories may include Random Access Memory (RAM) and Read Only Memory (ROM). The computer system further may include a storage device, which may be a hard disk drive or a removable storage drive such as a floppy disk drive, optical disk drive, and the like. The storage device may also be other similar means for loading computer programs or other instructions into the computer system.

As used herein, the term "computer" may include any processor-based or microprocessor-based system including systems using microcontrollers, reduced instruction set circuits (RISCs), application specific integrated circuits (ASICs), logic circuits, and any other circuit or processor capable of executing the functions described herein. The above examples are exemplary only, and are thus not intended to limit in any way the definition and/or meaning of the term "computer."

The computer system executes a set of instructions that are stored in one or more storage elements, in order to process input data. The storage elements may also store data or other information as desired or needed. The storage element may be in the form of an information source or a physical memory element within the processing machine.

The set of instructions may include various commands that instruct the computer as a processing machine to perform specific operations such as the methods and processes of the various embodiments of the invention. The set of instructions may be in the form of a software program. The software may be in various forms such as system software or application software. Further, the software may be in the form of a collection of separate programs, a program component within a larger program or a portion of a program component. The software also may include modular programming in the form of object-oriented programming. The processing of input data by the processing machine may be in response to user commands, or in response to results of previous processing, or in response to a request made by another processing machine.

As used herein, the term "software" includes any computer program stored in memory for execution by a computer, such memory including RAM memory, ROM memory, EPROM memory, EEPROM memory, and non-volatile RAM (NVRAM) memory. The above memory types are exemplary only, and are thus not limiting as to the types of memory usable for storage of a computer program.

The invention claimed is:

1. A system for facilitating smoke detector performance analysis comprising one or more servers configured to:

receive, from an alarm panel, a database of historical operational data containing plural measurements for a smoke detector operatively connected to the alarm panel, the historical operational data based in part on dirtiness of the smoke detector; and perform analytics based on the historical operational data in the received database, including being configured to:

determine, based on the historical operational data, an inflection point indicative of a recent cleaning or replacement of the smoke detector;

determine two or more trends of the smoke detector after the inflection point, wherein the two or more trends reflect dirt accumulation over two or more different data sets each over different times; and determine whether the smoke detector requires maintenance based on a correlation of the two or more trends.

2. The system of claim 1, wherein the historical operational data are configured in a desired format.

3. The system of claim 1, further comprising an alarm reporting network configured to communicate alarm conditions from the alarm panel to a monitoring entity, wherein the one or more servers are configured to receive the database over an analytics network separate from an alarm reporting network, wherein the analytics network is subject to less stringent regulatory requirements as compared to the alarm reporting network.

4. The system of claim 1, wherein the historical operational data includes:

a baseline average value associated with the smoke detector, wherein the baseline average value is a periodically or continuously updated average of output values of the smoke detector over time;

a peak value associated with the smoke detector;

a sensitivity value associated with the smoke detector, wherein the sensitivity value defines a number of counts above the baseline average value that is determined to be indicative of an alarm; and wherein the one or more servers are configured to determine a difference between the peak value and the baseline average value, and generate an adjustment to the sensitivity value based on the difference.

5. The system of claim 1, wherein the one or more servers are configured to use the historical operational data to perform an average value assessment by comparing a baseline average value associated with the smoke detector with predefined dirtiness threshold levels to categorize one or more levels of smoke detector dirtiness.

6. The system of claim 1, wherein the one or more servers are further configured to use the historical operational data to perform a directional vector analysis including being configured to:

subtract a first output value of the smoke detector generated at a first time from a second output value of the smoke detector generated at a second time after the first time to obtain a delta output value;

calculate a difference in time between timestamps of the first output value and the second output value;

generate a ratio or rate of change based on the delta output value and the difference in time; and wherein the one or more servers are further configured to determine whether the smoke detector requires maintenance based on the ratio or the rate of change.

7. The system of claim 1, wherein the one or more servers are further configured to use the historical operational data to perform peak analytics including being configured to:

examine a highest count value for the smoke detector during a given time period, as a percentage of an alarm value of the smoke detector; and determine, in response to the highest count value regularly traversing a first threshold value or a mean of the highest count value being above a second threshold value, that the smoke detector has an increased risk of producing a nuisance alarm.

8. The system of claim 1, wherein the one or more servers comprise:

a remote services server that is configured to receive, parse, and store the historical operational data;

an applications server that is configured to perform the analytics on the historical operational data; and a web portal server that is configured to make results of the analytics accessible for review.

9. The system of claim 8, wherein a client device connected to the web portal server is configured to display the results.

10. A method for facilitating smoke detector performance analysis comprising:

receiving, at a server, a database of historical operational data from an alarm panel, the historical operational data containing plural measurements for a smoke detector and being based in part on dirtiness of the smoke detector connected to the alarm panel; and performing analytics using the historical operational data in the received database, including:

determining, based on the historical operational data, an inflection point indicative of a recent cleaning or replacement of the smoke detector;

determining two or more trends of the smoke detector after the inflection point, wherein the two or more trends reflect dirt accumulation over two or more different data sets each over different times; and determining whether the smoke detector requires maintenance based on a correlation of the two or more trends.

11. The method of claim 10, wherein the historical operational data includes a baseline average value associated with the smoke detector, wherein the baseline average value is a periodically or continuously updated average of output values of the smoke detector over time.

12. The method of claim 10, wherein the historical operational data includes a sensitivity value associated with the smoke detector, wherein the sensitivity value defines a number of counts above a baseline average value that is determined to be indicative of an alarm.

13. The method of claim 10, wherein the historical operational data includes a peak value associated with the smoke detector.

14. The method of claim 10, wherein the receiving of the historical operational data comprises receiving over an analytics network that is separate from an alarm reporting network over which the alarm panel communicates alarm conditions to one or more monitoring entities, wherein the analytics network is subject to less stringent regulatory requirements as compared to the alarm reporting network.

15. The method of claim 10, wherein the server performing analytics using the historical operational data includes using the historical operational data to perform at least one of an average value assessment, a directional vector analysis, a trend analysis, and a peak analytics.

16. The method of claim 10, wherein communicating the historical operational data to the server comprises:

communicating the historical operational data to a remote services server that receives, parses, and stores the historical operational data;

communicating the historical operational data from the remote services server to an applications server that performs the analytics on the historical operational data; and communicating the historical operational data to a web portal server that makes results of the analytics accessible for review.

17. The method of claim 16, wherein the web portal server presents the results on a client device.

18. The method of claim 16, further comprising transmitting new sensitivity values to the alarm panel for smoke detectors that are determined to have an increased risk of nuisance alarm activation.

19. The method of claim 10, wherein the receiving of the historical operational data from the alarm panel comprises receiving at scheduled intervals.

20. The method of claim 19, further comprising transmitting a request to increase a frequency of the scheduled intervals in order to perform peak analytics.

21. The method of claim 19, further comprising transmitting a request to decrease a frequency of the scheduled intervals in order to perform trend analysis.

22. A system for facilitating smoke detector performance analysis, comprising:

a server configured to:

receive a database of historical operational data containing data of plural measurements for each of plural smoke detectors, the historical operational data being based in part on dirtiness of the smoke detectors; and perform analytics based on the historical operational data in the received database, including, for each smoke detector, being configured to:

determine, based on the historical operational data, an inflection point indicative of a recent cleaning or replacement of the smoke detector;

determine short, mid, and long term trends of the smoke detector after the inflection point; and determine whether each smoke detector requires cleaning maintenance based on a correlation of the short, mid, and long term trends.

* * * * *